US007575468B2

(12) United States Patent
Chien et al.

(10) Patent No.: US 7,575,468 B2
(45) Date of Patent: Aug. 18, 2009

(54) BATTERY CONNECTOR

(75) Inventors: Min-Lung Chien, Hsin-Tien (TW); Ping-Chuan Chu, Hsin-Tien (TW); Cui-Ping Gao, Hsin-Tien (TW)

(73) Assignee: Advanced Connectek Inc., Hsin-Tien, Taipei Hsien (TW)

( * ) Notice: Subject to any disclaimer, the term of this patent is extended or adjusted under 35 U.S.C. 154(b) by 0 days.

(21) Appl. No.: 12/171,495

(22) Filed: Jul. 11, 2008

(65) Prior Publication Data

US 2009/0023331 A1 Jan. 22, 2009

(30) Foreign Application Priority Data

Jul. 20, 2007 (TW) ..... 96211900 U

(51) Int. Cl.
*H01R 3/00* (2006.01)

(52) U.S. Cl. ..... 439/500; 439/627

(58) Field of Classification Search ..... 439/500, 439/627

See application file for complete search history.

(56) References Cited

U.S. PATENT DOCUMENTS 5,980,309 A * 11/1999 Frantz et al. ..... 439/500

FOREIGN PATENT DOCUMENTS

CN 2679862 2/2005

* cited by examiner

*Primary Examiner*—Javaid Nasri
(74) *Attorney, Agent, or Firm*—patenttm.us

(57) ABSTRACT

A battery connector has an insulative housing, a plurality of terminals and a holding bracket. The terminals are mounted in the insulative housing and each terminal has a contacting portion extending out of the insulative housing. The holding bracket covers the insulative housing and has a top portion, two side portions and two protective portions. The protective portions are formed on and protrudes forwards respectively from the side portions and extend forwards relative to the front of the insulative housing. The terminals are protected by the protective portions and would not permanently deformed by a battery pressing against the terminals.

6 Claims, 6 Drawing Sheets

BATTERY CONNECTOR

BACKGROUND OF THE INVENTION

1. Field of the Invention

The present invention relates to a connector, and more particularly to a battery connector that is durable and has fine electrical conductivity.

2. Description of Related Art

CN Patent No. 2,679,862 discloses a conventional battery connector mounted on a printed circuit board (PCB) and having an insulative housing, a holding bracket and a plurality of terminals. The holding bracket is mounted on the PCB and is mounted around the insulative housing to hold the insulative housing securely on the PCB. The terminals are mounted in the insulative housing.

However, the terminals pressing against a battery after a long period easily fatigue to cause irrecoverable and permanent deformation of the terminals. When an electronic device with the battery connector collides or falls off, the terminals of the battery connector are easily damaged.

To overcome the shortcomings, the present invention provides a battery connector to mitigate or obviate the aforementioned problems.

SUMMARY OF THE INVENTION

The main objective of the invention is to provide a battery connector that is durable and has fine electrical conductivity.

A battery connector in accordance with the present invention comprises an insulative housing, a plurality of terminals and a holding bracket. The terminals are mounted in the insulative housing and each terminal has a contacting portion extending out of the insulative housing. The holding bracket covers the insulative housing and has a top portion, two side portions and two protective portions. The protective portions are formed on and protrudes forwards respectively from the side portions and extend forwards relative to the front of the insulative housing. The terminals are protected by the protective portions and would not permanently deformed by a battery pressing against the terminals.

Other objectives, advantages and novel features of the invention will become more apparent from the following detailed description when taken in conjunction with the accompanying drawings.

DETAILED DESCRIPTION OF THE PREFERRED EMBODIMENT

With reference to FIGS. 1, 2, 5A and 5B, a battery connector in accordance with the present invention is mounted in a printed circuit board (PCB) (A) and comprises an insulative housing (10), a plurality of terminals (20) and a holding bracket (30, 30*b*).

Figure 1:
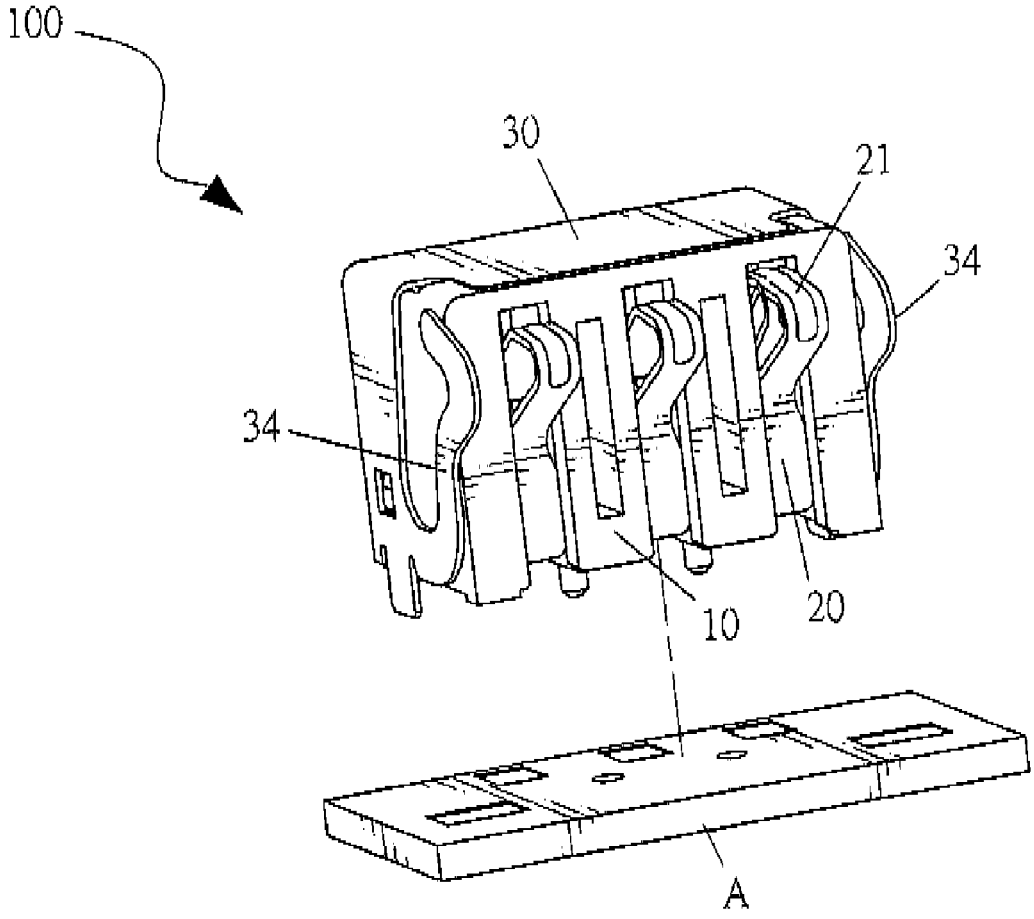
FIG. 1 is a partially exploded perspective view of a battery connector in accordance with the present invention.
Figure 2:
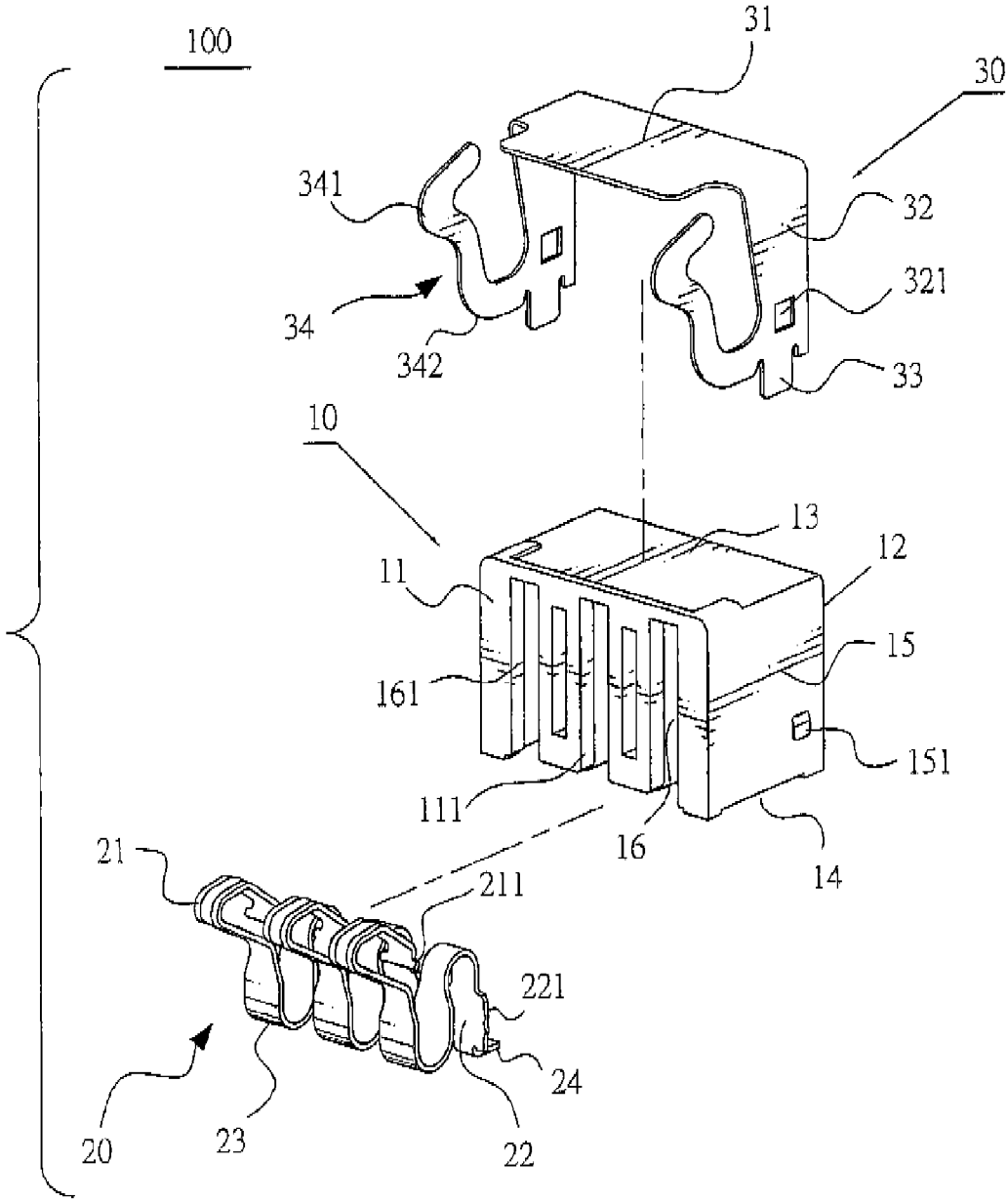
FIG. 2 is an exploded perspective view of the battery connector in FIG. 1.
Figure 3:
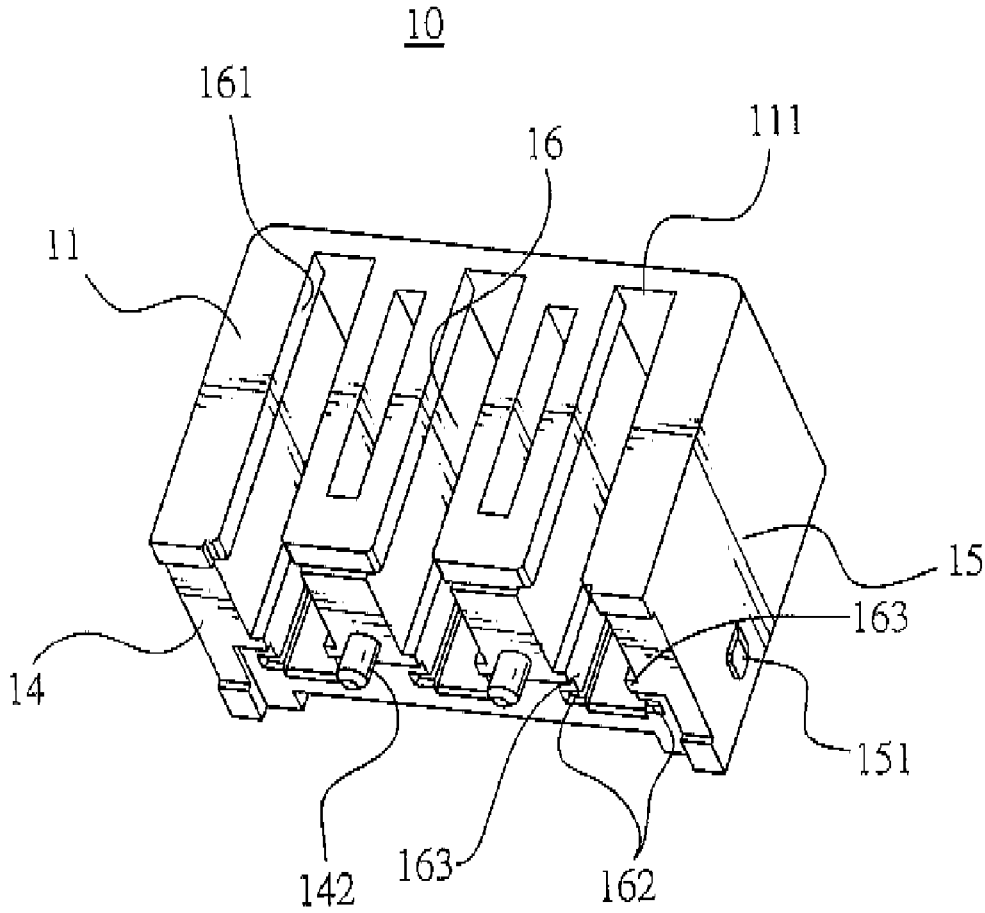
FIG. 3 is a perspective view of the battery connector in FIG. 1.

With further reference to FIG. 3, the insulative housing (10) has a front (11), a rear (2), a top (13), a bottom (14), two opposite sides (15), a plurality of cavities (16) and a plurality of retaining slots (162) and may further have two mounting blocks (151) and a plurality of mounting posts (142).

The cavities (16) are defined in the front (11) and the bottom (14) of the insulative housing (10) and each cavity (16) has two opposite inner sidewalls, a front opening (111) and two limiting lips (161) and may further have two opposite partitions (163). The front opening (111) is defined in the front (11) of the insulative housing (10). The limiting lips (161) are formed on and protrude respectively from the inner sidewalls at an interval and are adjacent to the front opening (111). The partitions (163) are formed on and protrude respectively from the inner sidewalls at an interval and are behind the limiting lips (161).

The retaining slots (162) correspond respectively to and communicate respectively with the cavities (16) and are defined in the bottom (14) of the insulative housing (10) behind the cavities (16). Each retaining slot (16) is separated from a corresponding cavity (16) by the partitions (163) of the corresponding cavity (16) and has an inner surface.

The mounting blocks (151) are formed on and protrude respectively from the sides (15) of the insulative housing (10).

The mounting posts (142) are formed on and protrude from the bottom (14) of the insulative housing (10) and are mounted through the PCB (A).

Figure 4:
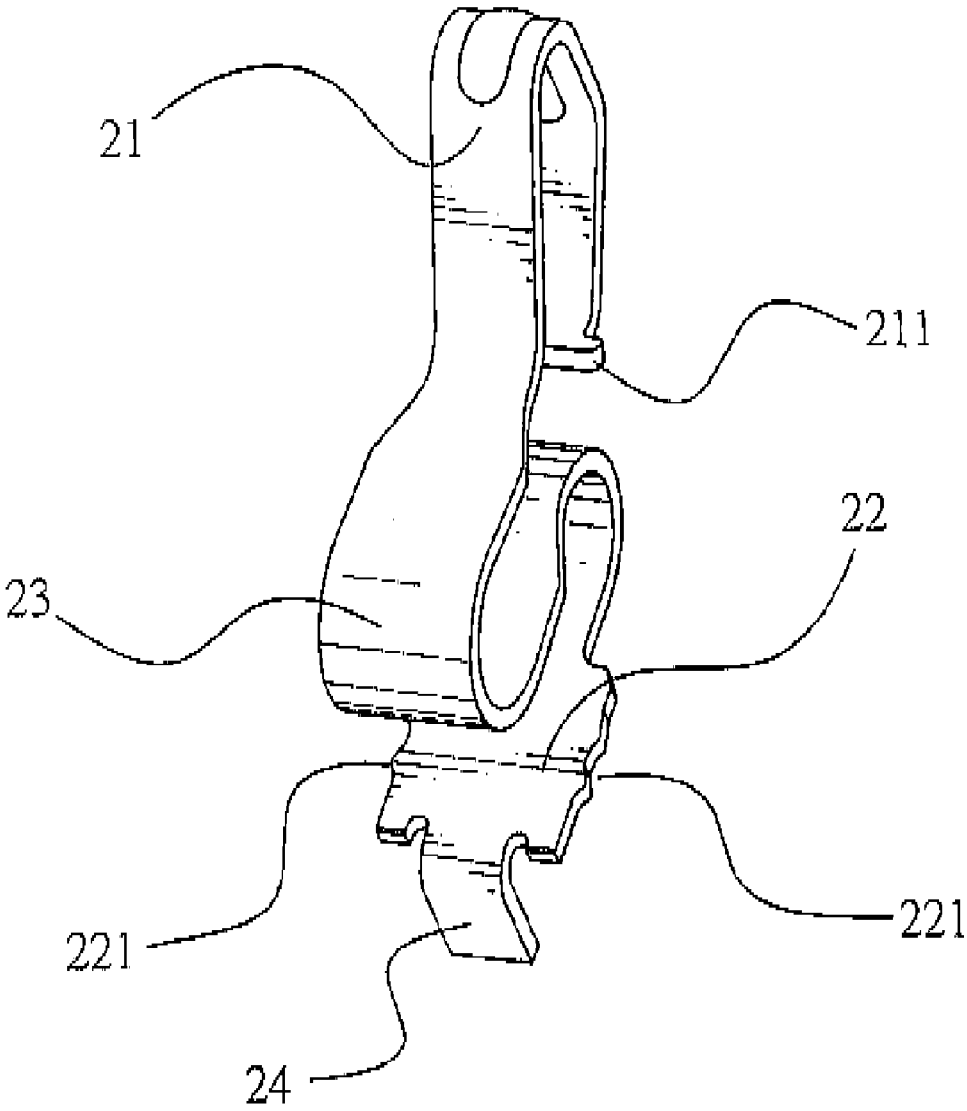
FIG. 4 is a perspective view of the terminal of the battery connector in FIG. 1.
Figure 5A:
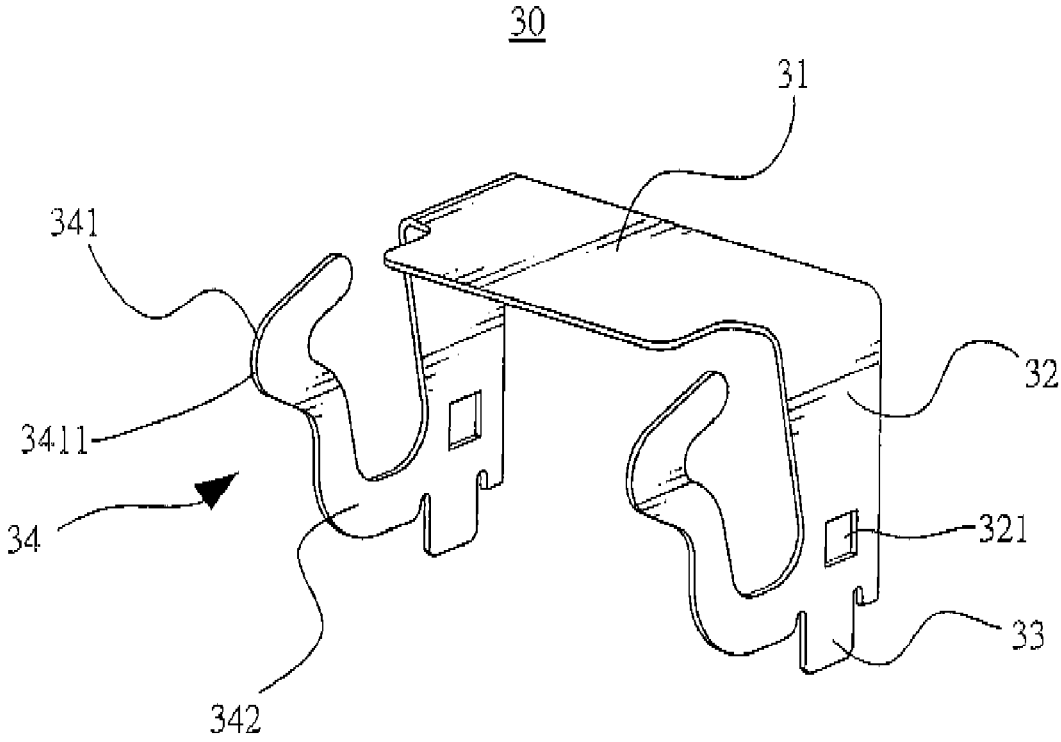
FIG. 5A is a perspective view of a first variant of the holding bracket of the battery connector in FIG. 2.
Figure 5B:
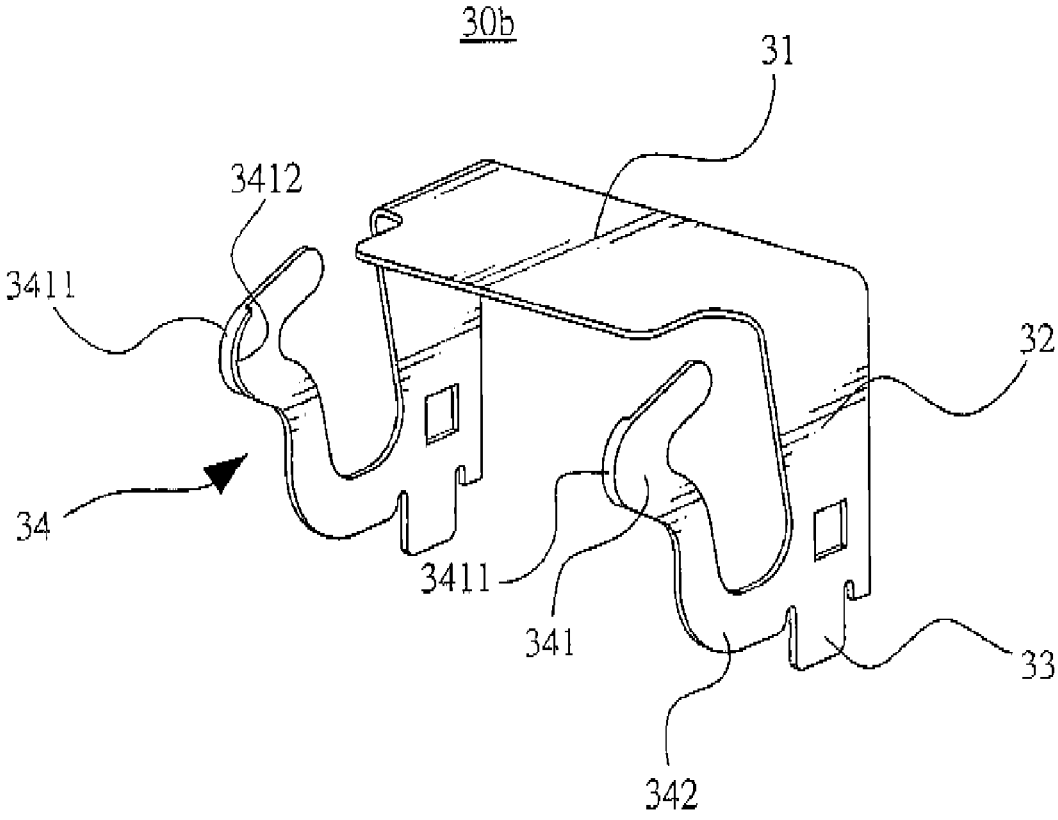
FIG. 5B is a perspective view of a second variant of the holding bracket of the battery connector in FIG. 2.

With further reference to FIG. 4, the terminals (20) corresponds respectively to the cavities (16) and the retaining slots (162), are mounted respectively in the cavities (16) and are mounted respectively in the retaining slots (162). Each terminal (20) has a contacting portion (21), a resilient portion (23), a body portion (22) and a soldering portion (24).

The contacting portion (21) is U-shaped, extends out of the front opening (111) of a corresponding cavity (16) and has a distal end and a hook (211). The hook (211) is formed on and transversely protrudes from the distal end and hooks on the limiting lips (161) of the corresponding cavity (16) to prevent the contacting portion (21) from falling out of the cavity (16).

The resilient portion (23) is S-shaped, is formed on and protrudes from the contacting portion (21) opposite to the hook (211) and is mounted in the corresponding cavity (16).

The body portion (22) is formed on and protrudes from the resilient portion (23), is mounted, in a corresponding retaining slot (162) and has two opposite sharp protrusions (221). The sharp protrusions (221) are formed on and protrude transversely outward from the body portion (22) and abut tightly against the inner surface of the corresponding retaining slot (162) to prevent the terminal (20) from swaying and moving.

The soldering portion (24) is formed on and protrudes from the body portion (22) and are soldered on contacts of the PCB (A).

The holding bracket (30, 30*b*) is made of metal, is U-shaped, may be formed from a sheet metal by a stamping process, is mounted on the insulative housing (10), covers the top (13) and the sides (15) of the insulative housing (10) and is mounted on the PCB (A) to securely bold the insulative housing (30, 30*b*) on the PCB (A). The holding bracket (30, 30*b*) has a top portion (31), two opposite side portions (32), two mounting portions (33) and two protective portions (34).

The top portion (31) is mounted on the top (13) of the insulative housing (10).

The side portions (32) are formed on and protrude perpendicularly from the top portion (31), are mounted respectively on the sides (15) of the insulative housing (15) and each side portion (32) has a bottom end and may further have a mounting hole (321). The mounting hole (321) is defined through the side portion (32) and is mounted around one of the mounting blocks (151) to prevent the holding bracket (30) from falling off.

The mounting portions (33) are formed on and protrude respectively from the bottom ends of the side portions (32) and are mounted through the PCB (A).

The protective portions (34) are formed on and protrude respectively forwards and upwards from the mounting portions (33) adjacent to the bottom ends, extend forwards relative to the front (11) of the insulative housing (10) and allow a battery to be installed between the protective portions (34) to prevent the battery from inadvertently shifting. Each protective portion (34) has a resilient section (342) and an abutting section (341). The resilient section (342) is curved and L-shaped and is formed on and protrudes from one mounting portion (33). The abutting section (341) is curved and V-shaped, is formed on and protrudes from the resilient section (342) and may have a curved front edge (3411) and an abutting tab (3412). The curved front edge (3411) abuts against the battery to prevent the battery from pressing excessively against the contacting portions (21) of the terminals (20) to cause irrecoverable deformation of the terminals (20). The abutting tab (3412) is curved, is formed on and protrudes transversely inwards from the curved front edge (3411) and abuts against the battery to increase a contacting area between the protective portion (34) and the battery.

The protective portions (34) of the holding bracket (30) prevent the battery from transversely shift that causes power transmission failure. Furthermore, the abutting sections (342) of the protective portions (34) abuts against the battery to prevent the battery from pressing overly against the contacting portions (21) of the terminal (20). The terminals (20) protected by the protective portions (34) would not deform irrecoverably and permanently. Therefore, the battery connector with the holding bracket (30) is durable and has fine electrical conductivity.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A battery connector comprising;

an insulative housing having a front;

a rear;

a top;

a bottom;

two opposite sides;

a plurality of cavities defined in the front and the bottom of the insulative housing and each cavity having two opposite sidewalls;

a front opening defined in the front of the insulative housing; and two limiting lips formed and protruding respectively from each said two opposite sidewalls at an interval and adjacent to the front opening; and a plurality of retaining slots corresponding respectively to and communicating respectively with the cavities, defined in the bottom of the insulative housing behind the cavities and each retaining slot having an inner surface; and a plurality of terminals corresponding respectively to the cavities and the retaining slots, mounted respectively in the cavities, mounted respectively in the retaining slots and each terminal having a contacting portion extending out of the front opening of a corresponding cavity and having a distal end and a hook formed on and transversely protruding from the distal end and hooking on the limiting lips of the corresponding cavity;

a resilient portion formed on and protruding from the contacting portion opposite to the hook and mounted in the corresponding cavity;

a body portion formed on and protruding from the resilient portion, mounted on a corresponding retaining slot and having two opposite sharp protrusions formed on and protruding transversely from the body portion and abutting tightly against the inner surface of the corresponding retaining slot; and a soldering portion formed on and protruding from the body portion; and a holding bracket covering the top and the sides of the insulative housing and having a top portion mounted on the top of the insulative housing;

two opposite side portions formed on and protruding perpendicularly from the top portion, mounted respectively on the sides of the insulative housing and each side portion having a bottom end;

two mounting portions formed on and protruding respectively from the bottom ends of the side portions; and two protective portions formed on and protruding respectively forwards and upwards from the mounting portions adjacent to the bottom ends, extending forwards relative to the front of the insulative housing and each protective portion having a resilient section formed on and protruding from one mounting portion; and an abutting section being curved and formed on and protruding from the resilient section.

2. The battery connector as claimed in claim 1 wherein the abutting section of each protective portion of the holding bracket has a curved front edge adapted to abut against a battery.

3. The battery connector as claimed in claim 2, wherein the abutting section of each protective portion of the holding bracket further has an abutting tab being curved, formed on and protruding transversely inwards from the curved front edge and adapted to abut against the battery.

4. The battery connector as claimed in claim 3, wherein, the resilient section of each protective portion portion of the holding bracket is curved and L-shaped.

5. The battery connector as claimed in claim 4, wherein the insulative housing further has a plurality of mounting blocks formed on and protruding from the bottom of the insulative housing.

6. The battery connector as claimed in claim 5, wherein:

the insulative housing further has two opposite mounting blocks formed on and protruding respectively from the sides of the insulative housing; and each side portion of the holding bracket further has a mounting hole defined through the side portion and mounted around one of the mounting blocks.

* * * * *